US005490886A

United States Patent [19]

Placek

[11] Patent Number: 5,490,886

[45] Date of Patent: Feb. 13, 1996

[54] METHODS FOR QUENCHING METAL

[75] Inventor: Douglas G. Placek, Fairless Hills, Pa.

[73] Assignee: FMC Corporation, Philadelphia, Pa.

[21] Appl. No.: 324,088

[22] Filed: Oct. 14, 1994

[51] Int. Cl.[6] ..... C21D 1/60

[52] U.S. Cl. ..... 148/637; 148/708; 148/687; 148/660

[58] Field of Search ..... 148/637, 708, 148/687, 660, 661

[56] References Cited

U.S. PATENT DOCUMENTS

| | | |
|---|---|---|
| 2,080,299 | 5/1937 | Benning et al. . |
| 2,284,695 | 12/1940 | Prutton . |
| 2,288,853 | 6/1942 | Downing et al. . |
| 3,022,205 | 2/1963 | Chase et al. . |
| 3,400,023 | 9/1968 | McDonald . |
| 3,607,758 | 9/1971 | Langenfeld . |
| 3,718,596 | 2/1973 | Richard . |
| 3,729,417 | 4/1973 | Hashimeto et al. . |
| 3,957,543 | 5/1976 | Shinomija et al. . |
| 4,263,062 | 4/1981 | Anzenberger . |
| 4,593,745 | 6/1986 | Yu et al. . |
| 4,969,959 | 11/1990 | Marr et al. . |

FOREIGN PATENT DOCUMENTS

| | | |
|---|---|---|
| 742661 | 9/1966 | Canada . |
| 1386307 | 12/1964 | France . |
| 619458 | 9/1935 | Germany . |
| 775571 | 5/1957 | United Kingdom . |

*Primary Examiner*—Deborah Yee

*Attorney, Agent, or Firm*—Patrick C. Baker; Robert L. Andersen; Charles C. Fellows

[57] ABSTRACT

A method for quenching hot metals especially iron steel or copper with a quenching fluid comprising a major proportion of an organic phosphate ester. The preferred esters are trialkyl phosphates and tri(alkyl phenyl) phosphates. The quenched article may exhibit improved anti-wear properties.

11 Claims, No Drawings

METHODS FOR QUENCHING METAL

FIELD OF THE INVENTION

This invention relates to novel methods for quenching metals and more particularly to methods which improve the anti-wear performance of the quenched metal. The invention finds particular application in the quenching of steel.

BACKGROUND TO THE INVENTION

Hardening metals such as steel by quenching operations is well known in the art and is widely practiced. Aqueous and oil based quenchants are both commonly used. The quenchants rapidly remove heat from hot metals and in doing so capture a desired microstructure. Control of the quenching process is used to obtain metal products having particular physical properties.

Aqueous based quenching fluids are widely used in industry. They offer the swiftest rates of heat removal but this may be disadvantageous particularly for use with certain alloys or with pieces of thin cross section in that it may cause stress cracking in the metal product. Hydrocarbon based quench oils offer a slower rate of cooling and are also widely used. However, as naturally derived products the composition of such oils may vary and this can introduce significant variations in their performance as a quench oil. In addition they are flammable and their use may pose a fire hazard.

Typical hydrocarbon quench oils are derived from the distillation of petroleum oil and are similar to the base oils used in engine and industrial lubricants. They are complex mixtures of paraffinic and napthenic hydrocarbons as well as oxygenated, nitrogenated and sulphurated derivatives thereof. Quench oil performance can be modified by the introduction of additives that improve wettability or cooling rates or oil stability life and deposit forming tendencies.

U.S. Pat. No. 4,969,959 describes a method for enhancing the thermal quenching of a metal surface which comprises treating the surface with a solution or an emulsion containing a minor proportion of an acid phosphate ester.

U.S. Pat. No. 3,729,417 discloses mineral oil based quenching compositions which comprise a minor proportion of various additives, one class of which are the trialkyl and triaryl phosphate esters. U.S. Pat. No. 4,593,745 discloses processes for continuously casting light metal alloys especially lithium aluminum alloys which utilise organic coolants which coolants may be glycols, mineral oils or phosphate esters. The preferred coolant is ethylene glycol.

SUMMARY OF THE INVENTION

It is an object of the present invention to provide a process for quenching metals which uses a non-aqueous fluid of synthetic origin and controlled composition and is thereby capable of consistent reproduction. It is a further object to provide processes for quenching metals which reduce the fire hazards associated with the use of hydrocarbon oils. It is a further object to provide a quenching process which produces a product having improved anti-wear properties.

The above and other objectives are provided by the methods of the present invention which comprise the utilisation of trialkyl or triaryl or mixed trialkyl/aryl phosphate esters as quench oils. The methods preferably utilise a quench oil which comprises mainly of these phosphate esters. The methods of the present invention may be employed as part of any metal treatment process in which a hot metal is quenched in order to rapidly reduce its temperature. They may be used for example in conjunction with hot rolling processes, cold rolling processes, extrusion processes and tempering processes.

The methods of the present invention find particular application in the quenching of iron (including steel) or copper and alloys thereof but may be used to quench other metals such as aluminum and alloys thereof. The quenching of sudaces formed of iron, steel or copper or alloys thereof may be particularly advantageous in improving the anti-wear properties of the product.

DETAILED DESCRIPTION OF THE INVENTION

The present invention relates to improved processes for the thermal quenching of a hot metal surface. The processes are generally carried out by taking a metal which has been heated to a temperature which is greater than its critical temperature and quenching it using a fluid. The quenching may be carried out in any manner which reduces the temperature of the metal sufficiently rapidly. Any of the conventional techniques of the art may be employed including immersing the metal in a bath of the fluid and flooding the surface of the metal with a stream of the fluid.

The fluids used in the processes of this invention comprise at least a major proportion (at least 50% by weight) of a trialkyl, triaryl or mixed alkyl aryl phosphate ester. A number of such esters are manufactured as articles of commerce. They are useful inter alia as fire resistant fluids. Many of them are Factory Mutual System approved as "less hazardous" when used as hydraulic fluids in industrial environments where oil leakage could result in fire. The use of such fire resistant materials in the processes of this invention is inherently advantageous in so far as it reduces the fire hazards associated with bringing a hydrocarbon oil based quenching fluid into contact with a hot metal surface.

The phosphate esters are available as products having a wide range of viscosities eg, from 2 to 150 centistokes at 40° C. In the methods of this invention an ester can be selected which offers the desired quenching speed. The variety of phosphate esters which are commercially available ensures that their use provides a range of quenching speeds at least as broad as that currently available using hydrocarbon oil based non-aqueous fluids. In particular esters are available which can be used in quenching processes which require fast, medium or slow quenching speeds. The phosphate ester based fluids can also be used in martempering processes which utilise quenching fluids which are maintained at an elevated temperature typically a temperature in the range 95°–230° C. The phosphate esters upon which the quenching fluids useful in this invention may be based are those having the general formula I:

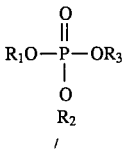

wherein $R_1$, $R_2$ and $R_3$ which may be the same or different represent a hydrogen atom, an alkyl group having from 1 to 20 carbon atoms, a halogen substituted alkyl group containing from 1 to 20 carbon atoms, an alkoxy substituted alkyl group containing a total of from 1 to 20 carbon atoms; a phenyl group or an alkyl substituted phenyl group wherein the alkyl substituents may comprise from 1 to 10 carbon atoms with the proviso that at least one of $R_1$, $R_2$ and $R_3$ represents a group other than a hydrogen atom.

The preferred phosphate esters are those wherein at least two of the groups $R_1$, $R_2$ and $R_3$ represent a group other than hydrogen and the most preferred esters are the neutral esters, ie, those esters having the formula I wherein $R_1$, $R_2$ and $R_3$ each represent a group other than a hydrogen atom.

An especially preferred group of phosphate esters are those having the formula I wherein $R_1$, $R_2$ and $R_3$ which may be the same or different represent phenyl group or alkyl substituted phenyl groups wherein the alkyl substituent comprises from 1 to 4 carbon atoms. A second especially preferred group are those esters having the formula I wherein $R_1$, $R_2$ and $R_3$ which may be the same or different represent alkyl groups comprising from 1 to 10 and most preferably from 4 to 10 carbon atoms.

Particular examples of phosphate esters which may be used in the processes of the present invention include tricresyl phosphate, cresyl diphenyl phosphate, trixylyl phosphate, xylyldiphenyl phosphate, tris (isopropyl phenyl) phosphate, tris (t-butyl phenyl) phosphate, (tris s-butylphenyl) phosphate, tertiary butyl/phenyl phosphates and secondary butyl phenyl phosphates, mixtures of triaryl phosphates which have been produced by the reaction of a phosphorylating agent such as phosphorus oxychloride with a mixture of phenols and alkylated phenols and especially those mixtures which have been produced by the alkylation of phenol with propylene or isobutylene, trioctyl phosphate, triethyl phosphate, tributyl phosphate, tributoxyethyl phosphate and trichloroethyl phosphate.

Mixtures of one or more of these phosphates may also be used in the processes of this invention. The phosphates may be blended so as to produce a quenching oil having particular desired characteristics such as a particular quenching speed.

The compositions useful as quenching oils in the processes of this invention may also contain other compatible materials. In particular the phosphate ester may contain a minor proportion of other fluids which are used as non-aqueous hydraulic fluids and lubricants such as the mineral oil based hydraulic fluids and the carboxylate esters based fluids including the trimellitates, adipates, sebacates and esters of trimethylolpropane and pentaerythritol. The phosphate esters may also be blended with a minor proportion of any of the known mineral oil based quenching compositions. The proportion of phosphate in such blends will generally be greater than 50% by weight and more usually the phosphate or phosphates will comprise at least 75 more preferably at least 90 and most preferably at least 95% by weight of the quenching oil. The oils may usefully comprise minor proportions of additives designed to improve wettability, to increase cooling rates or to improve the stability and life of the quenching oils. However in general we prefer to utilise compositions which comprise at least 95% by weight of phosphate ester or mixture of esters. Such compositions are particularly advantageous when it is desired to maximize the anti-wear properties of the quenched article. Without wishing to be bound by any theory the applicants believe that the phosphate ester reacts with the metal surface to form a film which imparts anti-wear properties to the metal. This improved anti-wear property is most readily achieved using a quench oil which comprises essentially only the phosphate ester.

The invention is illustrated by the following examples:

EXAMPLE 1

Several phosphate ester fluids were selected for evaluation. These products were :

| | ISO Grade | VISCOSITY cSt @ 40° C. | FLASH Point °C. | FIRE Point °C. | AUTOIGNITION Temp °C. |
|---|---|---|---|---|---|
| Tricresyl Phosphate - TCP | 32 | 30 | 255 | 338 | 600 |
| Isopropylphenyl Phosphate - IPPP | 68 | 65 | 255 | 345 | 490 |
| T-butylphenyl Phosphate - TBPP | 22 | 25 | 255 | 340 | 550 |
| –TBPP | 100 | 110 | 255 | 338 | 510 |
| Trioctyl Phosphate - TOP | 7 | 7 | 186 | 240 | 370 |
| Tris(2-ethylhexyl) Phosphate | 7 | 6 | 225 | 255 | 370 |

A study was designed to evaluate the wear characteristics of steel components quenched in phosphate ester fluids compared to a standard mineral oil. A procedure was developed that would allow polished steel bearings to be heated to form an austenite structure, then be quenched and tempered to a martensite structure with original hardness characteristics.

The specimens selected for use were E52100 steel bearings manufactured for use in the ASTM D4172 Four Ball Wear test. The use of these bearings allowed for the evaluation of surface coatings in a standard wear test. Table 1 lists several critical properties of E52100 steel.

TABLE 1

| AISI E52100 Steel Characteristics | | | | | |
|---|---|---|---|---|---|
| Composition | | | | | |
| % C | % Mn | % P | % S | % Si | % Cr |
| 0.95–1.10 | 0.25–0.45 | 0.025 max | 0.025 max | 0.20–0.35 | 1.30–1.60 |
| Steel Temperature for Oil Quench | | | 816–843° C. | | |
| Tempering Temperature | | | Resulting HRC Hardness | | |
| 93° C. | | | 63–64 | | |
| 149° C. | | | 62–63 | | |
| 204° C. | | | 60–61 | | |
| 260° C. | | | 58–60 | | |
| 316° C. | | | 55–57 | | |

The following quenching procedure was used for each bearing preparation:

Preheat furnace to 843° C.

Ultrasonically clean bearings in heptane, towel dry, heptane rinse.

Ultrasonically clean bearings in acetone, towel dry, acetone rinse, dry with $N_2$.

Place 4–6 clean bearings into a ceramic specimen holder, and set in the furnace. Allow furnace temperature to stabilise at 843° C. (typically 5 minutes), then start timer.

Remove specimen holder from furnace after 60 minutes (+1 min.) and immediately submerge in quench oil bath. The 1000 ml quench oil bath shall be located within 50 cm of the furnace door.

Agitate oil or oscillate specimen holder for 2 minutes, then allow specimens to stand in the oil bath for 3 minutes (5 minute total time in bath, +15 sec).

Remove specimen holder and allow it to stand in air at room temperature for 2 minutes. Allow excess oil to drain.

Ultrasonically clean quenched bearings in an appropriate solvent for 2 minutes (heptane for mineral oil, acetone for phosphate ester). Finish by rinsing with clean solvent.

The cleaning step must remove a residual carbon scale and organic residue from the bearing surface.

Dry bearings with a nitrogen stream at room temperature for 2 minutes.

Place bearings on a clean ceramic specimen holder and place into a preheated oven at 163±C. Temper in air at 163° C. for 60 minutes (+30 sec).

Remove specimen holder from oven and place directly into a desiccator.

Allow bearings to cool to room temperature for at least 4 hours before removing for testing.

The quenching/tempering procedure used for this study was successful in hardening each bearing to 60–63 Rockwell C hardness (HRC). Table 2 reviews the hardness measurements for several bearing sets. Each result reported is the average of three measurements taken from random locations on each bearing.

TABLE 2

| Bearing Hardness Measurements (HRC) | | | | | |
|---|---|---|---|---|---|
| Mineral Oil | TCP | IPPP | TBPP-22 | TBPP-100 | TOP |
| 62 | 62 | 63 | 62 | 61 | 63 |
| 60 | 62 | 60 | 61 | 62 | 62 |
| 61 | 60 | | | | 62 |

Mineral Oil quenched with no Temper—64

New Untreated Bearing—64

Maintaining a consistent hardness in each bearing set allows the results of the wear tests to be directly compared. The standard ASTM D4172 four ball wear test procedure was followed using an unadditized 100" paraffinic mineral oil as the reference lubricant. All tests were run at 600 rpm for 60 minutes at 75° C. under a 40 kg load. Table 3 presents the results of the wear tests conducted on bearings quenched in phosphate ester or mineral oil. Each result is the average of at least three wear tests. The wear scar for the mineral oil reference is the average of 12 wear test runs.

TABLE 3

Four Ball Wear Test Results, ASTM D4172
Conditions: 600 rpm, 40 kg, 75° C., 60 minutes

| Treatment | Average Wear Scar, mm | Average Mineral oil quench | % Improvement over Bearing |
|---|---|---|---|
| Mineral Oil | 1.285 | | — |
| TCP | 0.837 | | 35 |
| IPPP | 0.903 | | 30 |
| TBPP-ISO22 | 0.738 | | 43 |

TABLE 3-continued

Four Ball Wear Test Results, ASTM D4172
Conditions: 600 rpm, 40 kg, 75° C., 60 minutes

| Treatment | Average Wear Scar, mm | Average Mineral oil quench | % Improvement over Bearing |
|---|---|---|---|
| TBPP-ISO 100 | 0.710 | | 45 |
| TOP | 0.708 | | 45 |

I claim:

1. A method for quenching a hot metal, at least the surface of which is formed from iron, steel or copper or an alloy of iron, steel or copper, which comprises contacting the metal with a quenching fluid comprising a major proportion of an organic phosphate ester.

2. A method according to claim 1 wherein the phosphate ester is a compound having the formula I

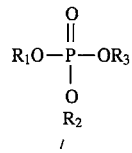

wherein $R_1$, $R_2$ and $R_3$ which may be the same or different represent a hydrogen atom, an alkyl group having from 1 to 20 carbon atoms, a halogen substituted alkyl group having from 1 to 20 carbon atoms, an alkoxy alkyl group having from 1 to 20 carbon atoms, a phenyl group or an alkyl substituted phenyl group wherein the alkyl substituents comprise a total of from 1 to 10 carbon atoms; with the proviso that at least one of $R_1$, $R_2$ and $R_3$ represent a group other than a hydrogen atom.

3. A method according to claim 2 wherein the phosphate ester is a compound of formula I wherein $R_1$, $R_2$ and $R_3$ each represent a group other than hydrogen.

4. A method according to claim 3 wherein $R_1$, $R_2$ and $R_3$ are selected from the group comprising phenyl groups and alkyl substituted phenyl groups wherein the alkyl substituent comprises from 1 to 4 carbon atoms.

5. A method according to claim 3 wherein $R_1$, $R_2$ and $R_3$ represent alkyl groups comprising from 1 to 10 carbon atoms.

6. A method according to claim 2 wherein the phosphate ester is selected from the group comprising tricresyl phosphate, cresyl diphenyl phosphate, trixylyl phosphate, xyxyl diphenyl phosphate, tris isopropylphenyl phosphate, tri(t-butylphenyl) phosphate; tris (sec butyl phenyl) phosphate, trioctyl phosphate, tributyl phosphate, triethyl phosphate, tri(butoxyethyl) phosphate and tri(chloroethyl) phosphate.

7. A method according to claim 2 wherein the phosphate ester is has been produced by the reaction of a phosphorylating agent with a mixture of phenols and alkylated phenols.

8. A method according to claim 7 wherein the mixture of phenols and alkylated phenols has been produced by the alkylation of phenol with propylene or isobutylene.

9. A method according to claim 1 wherein the quenching fluid comprises at least 95% by weight of organic phosphate ester.

10. A method according to claim 1 wherein the quenching fluid is maintained at an elevated temperature.

11. A method according to claim 10 wherein the quench bath is maintained at a temperature in the range 95° to 230° C.

* * * * *